US005094276A

United States Patent [19]

Caputo et al.

[11] Patent Number: 5,094,276

[45] Date of Patent: Mar. 10, 1992

[54] MIXING VALVE NOZZLE

[75] Inventors: Ernest P. Caputo, Nashua, N.H.; George Allison, Brick Town; Roy Valeo, Toms River, both of N.J.

[73] Assignees: Fluid Packaging Co., Inc., Lakewood, N.J.; Dow Chemical Co., Midland, Mich.

[21] Appl. No.: 726,394

[22] Filed: Jul. 5, 1991

Related U.S. Application Data

[62] Division of Ser. No. 248,599, Sep. 26, 1988, Pat. No. 5,046,538.

[51] Int. Cl.[5] ..... B65B 1/04; B67D 5/60

[52] U.S. Cl. ..... 141/9; 141/99; 222/559; 222/145

[58] Field of Search ..... 141/9, 11, 99, 82, 104, 141/105; 222/559, 380, 145, 459; 366/340, 177

[56] References Cited

U.S. PATENT DOCUMENTS

| | | | |
|---|---|---|---|
| 2,816,518 | 12/1957 | Dassett | 222/145 |
| 3,582,048 | 6/1971 | Sarem | 366/340 |
| 3,583,678 | 6/1971 | Harder | 366/390 |

*Primary Examiner*—Henry J. Recla
*Assistant Examiner*—Dave Walczak
*Attorney, Agent, or Firm*—Clifford G. Frayne

[57] ABSTRACT

A mixing valve nozzle for homogeneously mixing two fluid streams and dispensing a predetermined quantity of fluid into a container, the mixing valve having a housing with a centrally disposed valve stem, an inlet port, an outlet port and a second inlet port disposed therebetween, the valve stem having mixing means rotatably secured thereto comprising a plurality of mixing plugs axially mounted on the valve stem, each mixing plug containing a plurality of nonaligned conduit passageways to homogeneously mix the fluid entering the mixing valve nozzle from the first inlet and the fluid entering the mixing valve from the second inlet, during the dispensing phase.

6 Claims, 2 Drawing Sheets

FIG. 7
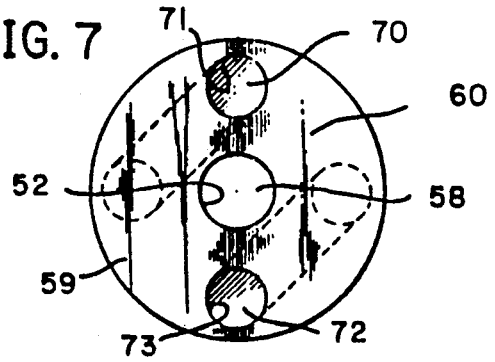
FIG. 5
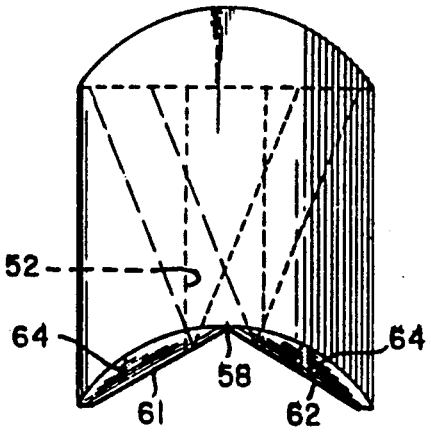
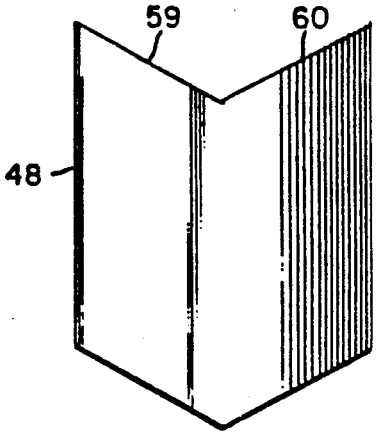
FIG. 4
FIG. 8
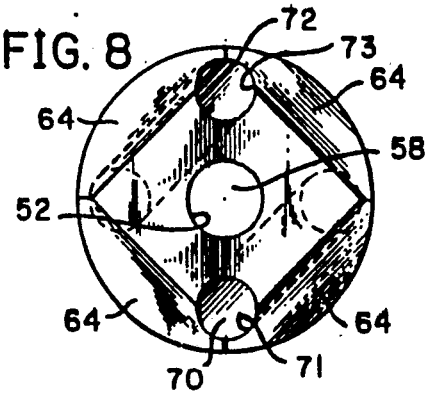
FIG. 6
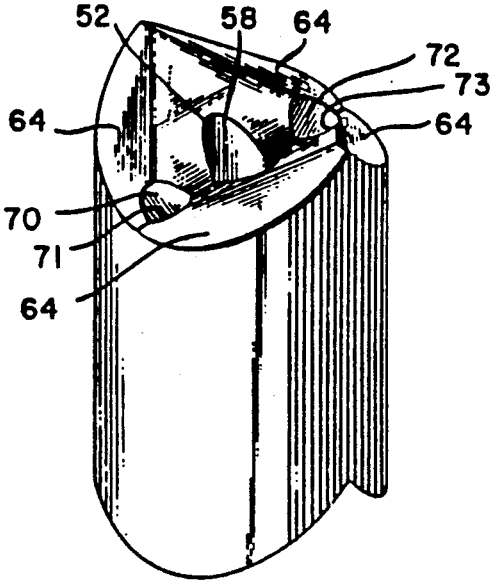

MIXING VALVE NOZZLE

This is a division of application Ser. No. 07/248,599, filed Sept. 26, 1988 now U.S. Pat. No. 5,046,538.

FIELD OF INVENTION

The present invention relates to the field of mixing nozzles and, in particular, to a mixing nozzle which dispenses a predetermined amount of fluid and simultaneously mixes a final temperature sensitive fluid ingredient within the mixing nozzle prior to dispensing into a container for further packaging.

BACKGROUND OF THE INVENTION

There exists in the marketplace a variety of flow nozzles and flow valves which serve to mix and/or discharge fluids and gases and chemical processes. In many instances, the mixture takes place through the natural turbulence of the fluids or gases in combination of the streams and the resultant flow of the mixture through subsequent conduits.

In the instant invention, as more fully set forth hereafter, certain compounds are mixed in a batch process for the metered dispensing into containers which are sold in retail to the customer. Due to the pressure and temperature constraints of the batch mixing process, certain key compounds which are vital to the performance of the finished product cannot be introduced into the batch process since the temperature/batch time parameters would destroy these active ingredients. In the particular case, these active ingredients consist of cleaning enzymes which are mixed with a filler material in the mixing nozzle and then dispensed into a container for further cooling and solidification.

It is therefore necessary to introduce the enzyme into the compound at the last possible moment and ensure that the enzyme is uniformly mixed with the product and then dispensed into the container which is then subjected to a setting chamber for solidification.

If the cleaning enzyme is not introduced at the proper time and mixed uniformly throughout the remaining mixture it will not serve as a cleaning component within the product or, if not mixed uniformly just prior to dispensing into the container, the container and product will not provide the purchaser with uniformly mixed cleaning product such that it may work with its initial dispensing and become depleted as the product is depleted or vice versa.

The present invention ensures that the enzyme is introduced into the mixture at the last possible moment prior to dispensing and that the enzyme is evenly mixed prior to dispensing into the container for transport to the setting chamber.

OBJECTS OF THE INVENTION

An object of the present invention is to provide a novel mixing nozzle which dispenses a predetermined quantity of fluid into a container and simultaneously mixes the ingredients of the fluid stream.

Another object of the present invention is to provide a novel and unique mixing nozzle which permits the introduction and mixing of one component of the fluid stream in the nozzle immediately prior to dispensing.

Another object of the present invention is to provide a novel and unique mixing nozzle which can continuously mix and dispense a predetermined quantity of the fluid stream into a container.

SUMMARY OF THE INVENTION

These and other objects of the present invention are achieved by a mixing nozzle comprising a chamber having a first inlet port for the introduction of a fluid stream, a lower outlet port for the dispensing of a fluid stream, a centrally disposed valve stem containing a stopper for the selective closure of the lower outlet port, the valve stem having a mixing plug, the chamber having a second inlet port for the introduction of an ingredient to the fluid stream, the second inlet port disposed between the first inlet port and the outlet port, the mixing plug activated and imparting turbulence to the fluid stream and the final ingredient during the stopper's upward movement in dispensing the predetermined fluid into a container.

BRIEF DESCRIPTION OF THE DRAWINGS

A better understanding of the present invention as well as other objects and advantages thereof will become apparent upon consideration of the detailed disclosure thereof especially when taken with the accompanying drawings wherein:

FIG. 4 is a front elevational view of one mixing plug of the mixing nozzle.

FIG. 5 is a side elevational view of one mixing plug of the mixing nozzle.

FIG. 6 is a perspective view of a mixing plug of the mixing nozzle.

FIG. 7 is a top planer view of a mixing plug of the mixing nozzle.

FIG. 8 is a bottom planer view of a mixing plug of the mixing nozzle.

DETAILED DESCRIPTION OF THE DRAWINGS

Figure 1:
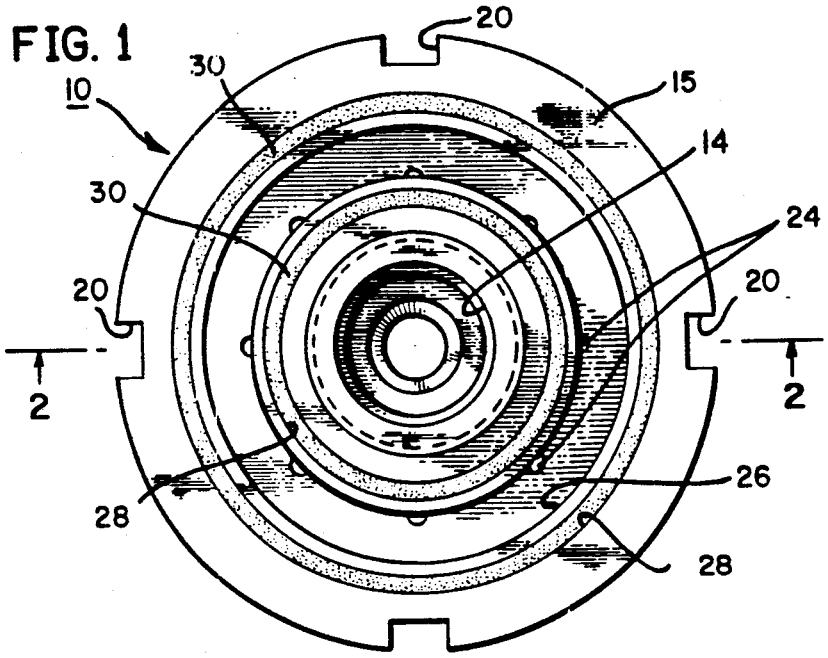
FIG. 1 is a top planer view of the mixing nozzle.
Figure 2:
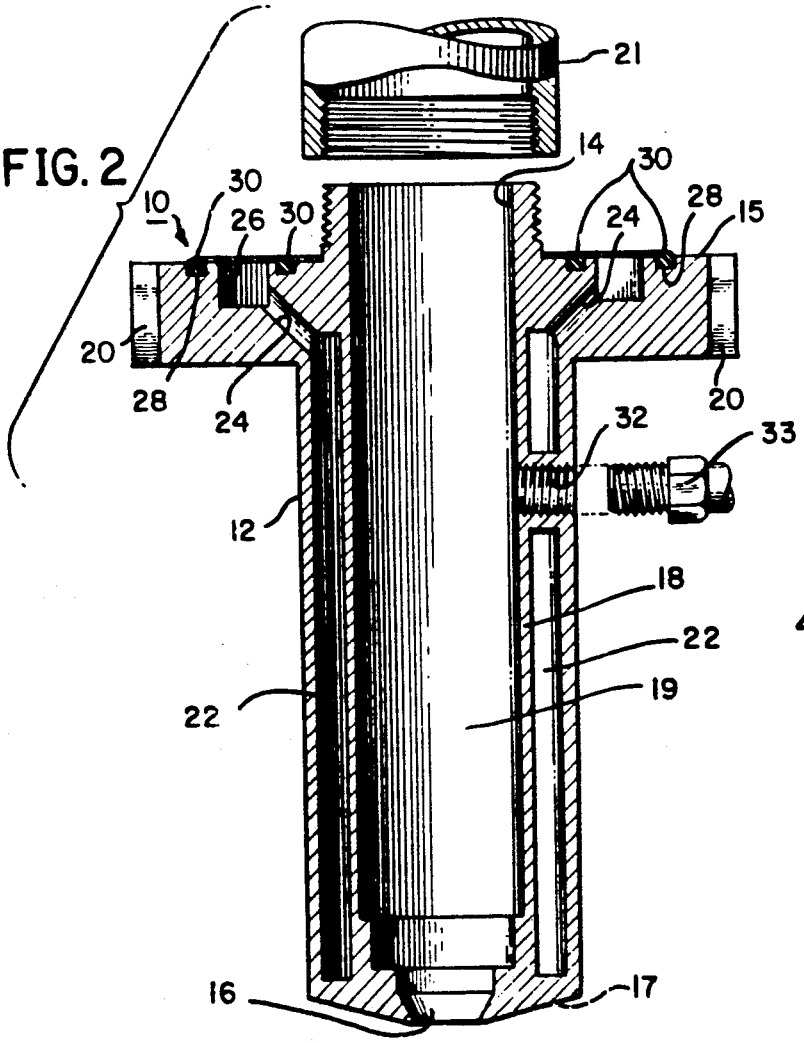
FIG. 2 is a side cross sectional view of the mixing nozzle along plane 2—2.

Referring to FIG. 1, there is shown a top planer view of mixing nozzle 10. Mixing nozzle 10 will be best understood by reference to FIG. 1 and FIG. 2 which is a side cross-sectional view of mixing nozzle 10 along plane 1—1 of FIG. 1.

Mixing nozzle 10 comprises a casing 12 which in this embodiment is generally cylindrical in nature having a protruding exteriorly threaded inlet port 14 at upper end 15 and an outlet port 16 at opposite lower end 17. Inlet port 14 and outlet port 16 are in communication with each other by means of interior conduit sleeve 18 which defines valve conduit 19. Mixing nozzle 10 has an annular flange 20 positioned circumferentially about inlet port 14 for cooperation with threaded inlet port 14 in mounting the mixing nozzle 10 to the conduits from dispensing chamber 21 which will provide the first fluid stream to mixing nozzle 10 and, in particular, inlet port 14.

It is desirable to control the temperature within mixing nozzle 10 in operation, and in that regard, casing 12 and inner sleeve 18 define an annular space 22 for the flow of heating or cooling water about interior valve conduit 19. The heating or cooling water is introduced by means of a plurality of inlet ports 24 positioned in annular groove 26 in annular flange 20. The plurality of inlet ports 24 permits the circulation of heating or cooling water into annular space 22 and the exit of same in order to maintain the desired temperature of interior conduit 19 and the fluid stream passing therethrough.

In order to provide for an adequate seal with respect to the mounting of mixing nozzle 10 to the dispensing chamber 21, there are a plurality of circular indents 28 about annular flange 20 to provide for the insertion of 0 ring gaskets 30 to provide such a seal.

Mixing nozzle 10 has a second inlet port 32 which in this embodiment is internally threaded for receipt of an inlet conduit 33. Inlet port 32 extends from outer casing 12 to inner sleeve 18 and provides for a conduit passage to interior valve conduit 19.

In this configuration, the bulk fluid stream is introduced into mixing nozzle 10 through inlet port 14 and a second fluid stream which comprises the temperature sensitive ingredient is introduced into mixing nozzle 10 through inlet port 32. Both streams are introduced simultaneously in predetermined quantities in a manner set forth hereafter.

Figure 3:
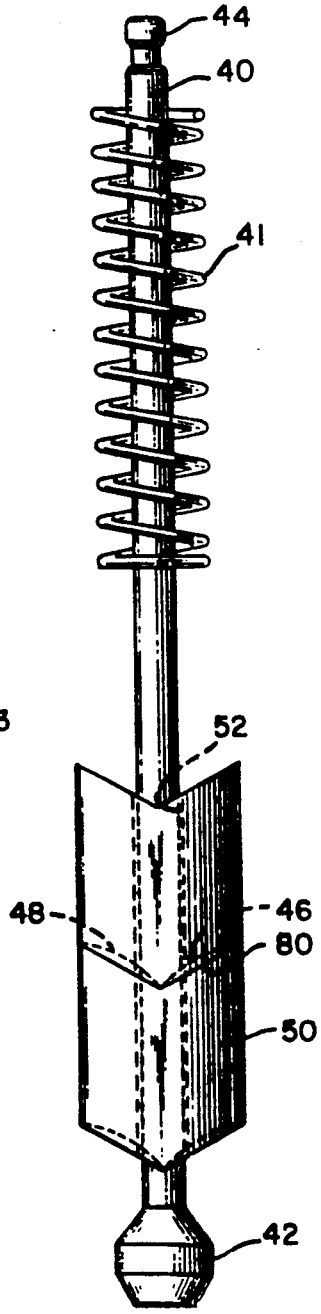
FIG. 3 is a side elevational view of the internal valve stem and mixing plugs of the mixing nozzle.

Referring to FIG. 3, there is shown the valve stem 40 having a lower stopper end 42 for cooperation with outlet port 16. Stopper 42 has substantially the same configuration as outlet port 16 in order to seal outlet port 16 when valve stem 40 is in its lower most position. Valve stem 40 has a notched connecting means 44 at its upper end for connection to the valve activation mechanism and a spring means 41 to assist in the operation of valve stem 40.

Axially mounted on valve stem 40 is a mixing mechanism 46. Mixing mechanism 46 comprises a two-piece mixing plug comprised of upper mixing plug 48 and lower mixing plug 50. Both are circular in cross-sectional area and the cross-sectional area substantially conforms to the cross-sectional area of interior valve conduit 19 of mixing nozzle 10. Mixing plugs 48 and 50 have a centrally-disposed aperture 52 which allows mixing mechanism 46 to be slidably rotatably secured on valve stem 40. Mixing mechanism 46 can best be understood with reference to FIG. 4 which is a front elevational view of mixing plug 48, FIG. 5 which is a side elevational view of mixing plug 48, FIG. 6, which is a perspective view of mixing plug 48 along, FIG. 7 is a top planer view of mixing plug 48 and FIG. 8 which is a bottom planer view of mixing plug 48. Mixing plugs 48 and 50 are identical with respect to their features and detailed reference is hereafter made with respect to mixing plug 48.

Mixing plug 48 is generally circular in cross- sectional area, its cylindrical shape conforming with the cross-sectional area of internal valve conduit 19. The upper surface of mixing plug 48 is defined by a downwardly depending V-shaped surface 54 and the lower end of mixing plug 48 is defined by an upwardly positioned V-shaped surface 58. The V-shaped cuts defining V-shaped surfaces 54 and 58 are 90° in opposition to each other. Upper V-shaped surface 54 is defined by two intersecting planer surfaces 59 and 60. Lower V-shaped surface 58 is defined by two intersecting planes 61 and 62. However, lower V-shaped surface 58 has its planer elements 61 and 62 trimmed to define a beveled surface 64 where planer element 61 and 62 intersect the circumferential edge of mixing plug 48.

Aperture 52 is centrally disposed through mixing plug 48 communicating from upper V-shaped surface 54 to lower V-shaped surface 58. Mixing plug 48 has two additional conduits passing therethrough, conduit 70 and conduit 72. Conduit 70 and 72 have their upper apertures 71 and 73 respectively positioned in upper V-shaped surface 54 at the intersection of intersecting planer surface 59 and 60. Conduits 70 and 72 pass interiorly through mixing plug 48 and terminate at lower V-shaped surface 58 at the intersection of planer surfaces 61 and 62 of lower V-shaped surface 58. In this configuration, conduit 70 and 72 pass angularly as opposed to vertically through mixing plug 48.

As previously stated, lower mixing plug 50 is identical with upper mixing plug 48. When the upper V-shaped surface 54 of lower mixing plug 50 is mated to the lower V-shaped surface 58 of upper mixing plug 48, the beveled surface 64 of upper mixing plug 48 contact the planer surfaces 59 and 60 of upper V-shaped surface 54 of mixing plug 50. A spacial cavity 80 is therefore defined between upper mixing plug 48 and lower mixing plug 50 and the lower apertures of conduits 70 and 72 in upper mixing plug 48 are 90° opposed to the entering apertures of conduits 70 and 72 in lower mixing plug 50. In operation, this offset combined with the circumferential contact of the walls of mixing plugs 48 and 50 with inner valve conduit 19, defines a tortuous path through mixing plugs 48 and 50 which the fluid stream from inlet port 14 and inlet port 32 must follow in order to exit through outlet port 16. It is this tortuous path through which the fluid stream must pass which creates the necessary turbulent mixing to ensure that the temperature sensitive ingredient entering interior valve conduit 19 through inlet port 32 is thoroughly mixed with the fluid stream entering through inlet port 14.

In operation, a container for the receipt of the dispensed fluid stream would be placed in registration with outlet port 16 with outlet port 16 effectively sealed by stopper 42. A predetermined measured amount of the first fluid stream would be pistonly fed through inlet port 14 into interior valve conduit 19. Simultaneously, a predetermined measured amount of the second fluid stream would be pistonly fed through inlet port 32 into interior valve conduit 19. Simultaneously with the piston feed, valve stem 19 would be activated upwardly opening outlet port 16 and the piston feed from the two fluid streams would force the streams through the tortuous path defined in mixing plugs 48 and 50 and thence. outlet port 16 to the container. Valve stem 40 would then be activated downwardly to seal outlet port 16 and the process would be repeated sequentially.

I claim:

1. A mixing valve nozzle for the dispensing of a predetermined quantity of fluid into a container, said fluid received from separate fluid streams by said mixing valve nozzle and homogeneously mixed in the nozzle immediately prior to dispensing, said mixing valve nozzle comprising:

a housing defining a chamber for receipt of said fluid streams, said chamber having a first inlet port, an outlet port, and a second inlet port disposed between first inlet port and said outlet port;

a valve means comprising a valve stem axially aligned with said outlet port, said valve stem having a valve stopper complimentary with said outlet port for sequentially opening and closing said outlet port, said valve stem having a spring means mounted thereon for limiting the vertical displacement of said valve stem and cooperating with said valve stem and cooperating with said valve stopper to close said outlet port, said valve stem having disposed thereon between said spring means and said stopper, a mixing plug axially mounted on said valve stem, said plug substantially identical in cross sectional area with the interior cross sectional area of said chamber, said plug having disposed therethrough, a plurality of apertures defining a tortuous path through said plug to aid in the mixing and blending of a first fluid stream entering said first inlet port and a second fluid stream entering said second inlet port.

2. An apparatus in accordance with claim 1 wherein said housing is jacketed to provide for cooling or heating water to maintain a desired temperature in said chamber.

3. An apparatus in accordance with claim 1 wherein mixing assembly comprises a plurality of plugs interlocked, each said plug containing a plurality of nonaligned apertures defining a tortuous path through said plug for the mixing and blending of said fluid steams and interlocking plugs defining a cavity therebetween for communication between said nonaligned apertures.

4. An apparatus in accordance with claim 1 wherein the vertical displacement of said valve stem is limited to prevent said mixing assembly from sealing said second inlet port.

5. An apparatus in accordance with claim 1 wherein said first inlet stream and said second inlet stream are sequenced to pistonally dispense a predetermined amount of fluid into said chamber simultaneously for mixing and subsequent dispensing into a container.

6. An apparatus in accordance with claim 1 wherein said valve stem and said valve stopper operates in a closed position to permit registration of a subsequent container beneath said mixing valve.

* * * * *